United States Patent [19]

Steidle et al.

[11] Patent Number: 4,588,194

[45] Date of Patent: May 13, 1986

[54] TARGET DEVICE WITH REMOTE RESETTING MEANS

[76] Inventors: Daniel L. Steidle; Patrick J. Steidle, both of 9540 Lansford Dr., Cincinnati, Ohio 45242

[21] Appl. No.: 697,725

[22] Filed: Feb. 4, 1985

[51] Int. Cl.[4] ..... F41J 1/14; F41J 7/04

[52] U.S. Cl. ..... 273/391; 273/392; 273/410

[58] Field of Search ..... 273/390, 391, 392, 410

[56] References Cited

U.S. PATENT DOCUMENTS

| | | | |
|---|---|---|---|
| 1,125,306 | 1/1915 | Graybill | 273/391 |
| 1,267,722 | 5/1918 | Walter | 273/391 |
| 1,528,662 | 3/1925 | Ewing | 273/391 |
| 1,733,606 | 10/1929 | Junker | 273/391 X |
| 3,104,874 | 9/1963 | Slimovitz | 273/391 X |
| 3,411,784 | 11/1968 | Lawrence | 273/390 |
| 4,029,318 | 6/1977 | Boss | 273/102 |

*Primary Examiner*—Anton O. Oechsle

*Attorney, Agent, or Firm*—Charles R. Wilson

[57] ABSTRACT

A remote controlled target device comprises a housing with an open front face, side panels and back and bottom panels angled to deflect misses projectiles back into the rear portion of the housing. A pivot bar extending across the housing holds a plurality of targets which are attached so as to permit them to revolve to knock-down positions when hit. A return bar is controlled by a cord which extends to a remote location to effect resetting the targets.

15 Claims, 10 Drawing Figures

TARGET DEVICE WITH REMOTE RESETTING MEANS

This invention relates to target devices capable of being reset from a remote location. More particularly, the invention relates to portable target devices which can be used indoors and which have targets resettable from a remote location.

BACKGROUND OF THE INVENTION

Targets of various types have been used extensively for many years by gun enthusiasts. The most basic targets include the traditional bullseye target printed on paper or paperboard. Such targets are hung on a frame or supported in some manner in an outdoor location remote from any area frequented by people. The gun enthusiast paces off a certain distance and proceeds to test his shooting skills on the target. Eventually the target becomes unusable due to repeated hits and must be replaced.

Target practice with the above-described basic type of a target can be enjoyable, but does not provide the same satisfaction derived from hitting a moving target or causing the target itself to move after a direct hit. Target devices found in shooting galleries are oftentimes mechanical with moving targets. As the target moves laterally across the target area or revolves, the gun enthusiast is presented with a challenge greater than that presented by a stationary object. Such mechanical target devices generally have targets which are knocked down when contacted by a bullet. Many such devices also have automatic reset means to reposition the targets to an upright position.

Still other commercial type target devices found in shooting galleries or rifle ranges comprise stationary targets with automatic or semi-automatic reset means. Thus, when the target is knocked down, means are provided for automatically or semi-automatically resetting it to an upright position. This offers the gun enthusiast the opportunity to test his shooting skills without the interruption and annoyance of continually replacing or resetting the targets. Portable type target devices with remote target resetting means are illustrated in U.S. Pat. Nos. 1,267,722; 1,657,931; 3,411,784; and 4,029,318. Unfortunatley, not every gun enthusiast has access to the aforedescribed devices. Additionally, complex designs of these devices cause them to be too expensive to produce economically or too prone to product failure.

Another drawback experienced with most target devices disclosed in the prior art is that devices intended for use with high calibre rifles or guns are designed for use either in a shooting gallery environment or outdoors, e.g. at a rifle range. This, of course, is because of safety concerns.

There is a need for a target device not met by the known target devices. Many gun enthusiasts would like the convenience of having a target device which could be used in their own homes, for example, in a basement area. Such a device would have to be safe and, at the same time, capture the interest of the gun enthusiast. Ideally, such a device would be portable and of a simple design to allow for economy of manufacture. Also important would be a feature which would allow the gun enthusiast to spend the maximum time in shooting and not replacing or resetting targets. A means for resetting hit targets from a remote location would be highly desirable. There has now been discovered a target device which meets the above stated needs of portability, interest, simple design and remote target reset means.

SUMMARY OF THE INVENTION

In accordance with this invention, there is provided a portable target device with means for resetting knocked-down targets from a remote location. The target device comprises a housing with an open front face and targets mounted within the housing. The housing has a back panel capable of withstanding the impact of a missed projectile. It and the bottom panel are preferably sloped to cause missed projectiles to be caught in the housing. A horizontal target pivot bar extends across the housing and is mounted at either end in the side panels of the housing. A plurality of targets are mounted on the pivot bar at spaced intervals. The targets comprise a target face, means of attachment to the pivot bar so as to permit revolving movement of the target about the pivot bar and a bar connecting the target face with the means of attachment. A target reset means for remotely moving the targets from a knock-down position to an upright position comprises: (1) a return bar positioned behind the pivot bar and configured such that when it revolves about its axis a portion of it comes in contact with the knocked-down targets and moves them into an upright position; (2) a spring attached at one of its ends to one extremity of the return bar and at its other end to the housing; and (3) a cord extending from said extremity of the return bar, through a guide loop and to a remote location.

After the targets on the target device have been knocked down, the gun enthusiast merely pulls on the cord to cause the return bar to revolve and reset the targets. The action of the spring causes the return bar to resume its normal rest position.

DETAILED DESCRIPTION OF THE INVENTION

Figure 1:
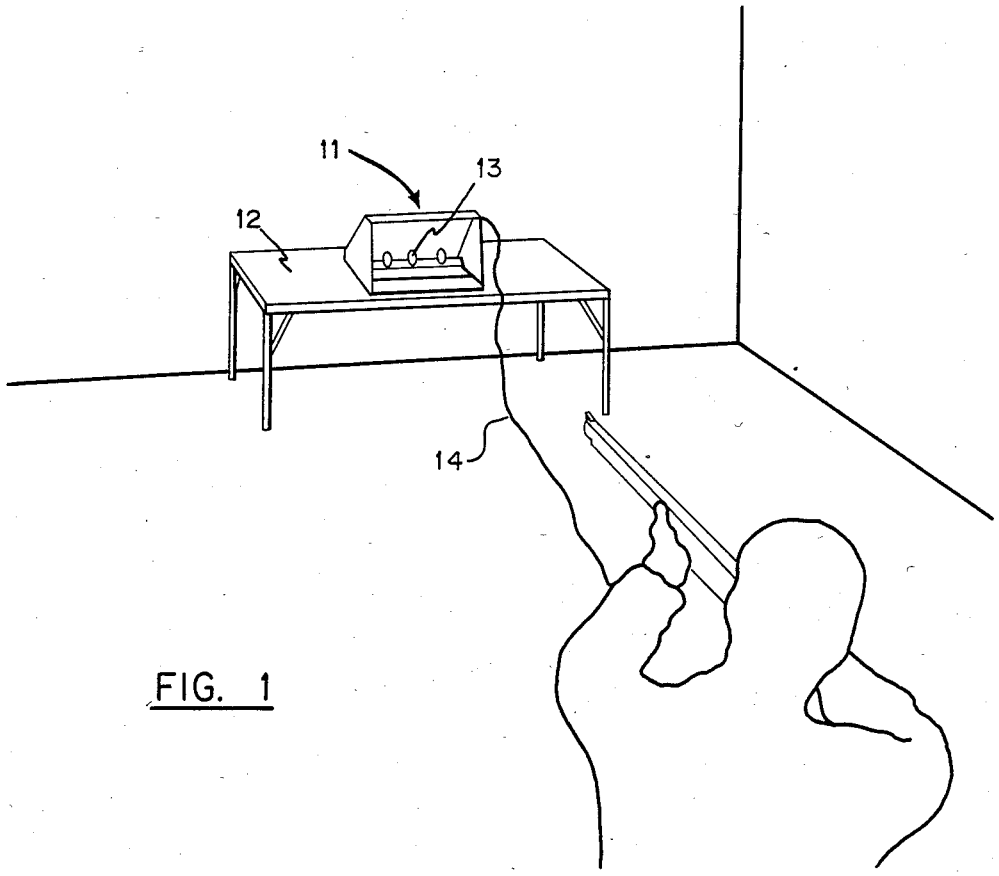
FIG. 1 is an environmental view of the target device of this invention.

Referring now to the drawings, the target device of this invention is shown in FIG. 1 in its preferred environmental setting. The target device 11 is set on a support member 12 in an indoor location, e.g., a basement. A cord 14 leads from the target device to the gun enthusiast. When the gun enthusiast fires and hits a target 13, the target will be knocked backwards and will remain in the knocked-down position. After all the targets are hit, the cord 14 is sharply pulled by the gun enthusiast from his original position of fire. The pull on the cord causes the targets to be reset, ready for additional target practice. The target device 11 is described in more detail in the following paragraphs and with reference to FIGS. 2 through 10.

Figure 2:
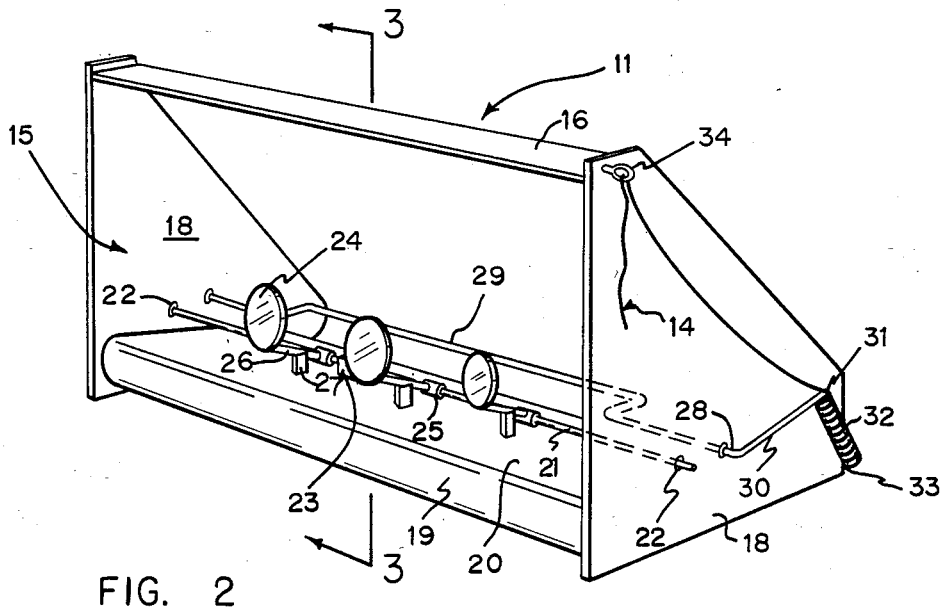
FIG. 2 is a perspective view of the target device showing the targets in an upright position.
Figure 3:
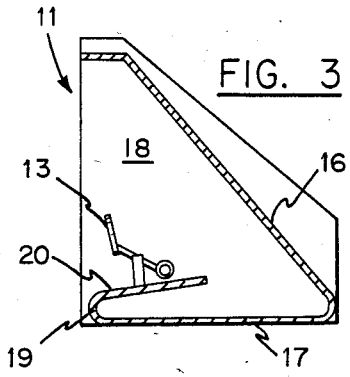
FIG. 3 is a cross-sectional view taken along line 3—3 of FIG. 2.

As shown in more detail in FIGS. 2 and 3, the target device 11 comprises a housing having an open front face 15, a back panel 16, a bottom panel 17 and two side panels 18. The back panel 16 slopes in a downward direction from its top to the point where it meets the back of the bottom panel 17. The back panel can be one flat plate sloping down and away directly from the leading edge of the top of the open front face to the back of the bottom panel or, as shown, can be bent near the top so as to form a top panel essentially horizontal to the bottom panel. The back panel and top panel can be all one piece configured as shown or can be two pieces appropriately joined together, such as by welding. The sloped nature of the back panel is desired for safety reasons. Thus, any missed projectiles will be directed downward where they will be trapped in the housing.

The bottom panel 17 serves the dual function of acting as a base for the housing and as a support for the targets 13. This panel can be a flat single piece of material of a rectangular shape with the targets and target pivot bar mounted directly above it. Shown best in FIG. 3 the bottom panel preferably has three sections, a bottom support section 17, a return section 19 and a cover section 20. The bottom support section 17 extends from the back panel 16 towards the open front face and then turns back on itself and extends about midway into the housing. The return portion 19 of the bottom panel is rounded for ease of manufacture and for safety reasons. Thus, the rounded nature of the return portion causes missed projectiles to be directed either upwardly or downwardly—but not directly backwardly. In a similar fashion, the extended cover section 20 of the bottom panel slopes in an upward fashion from the open front face towards the back panel. This sloped portion also directs missed projectiles into the back of the housing. An added benefit derived from the three section bottom panel is that it acts as a trap for missed projectiles which fall to the bottom of the housing. After sufficient use, the target device can be emptied of the missed projectiles. The back panel, top panel (if any), and bottom panel (including all three sections) can be fabricated from one piece of metal. This allows for ease of manufacture.

Side panels 18 are shaped according to the dimensions of the back and bottom panels, 16 and 17, respectively. The side panels merely provide support and stability to the remaining parts of the target device.

A horizontal target pivot bar 21 extends from one side panel to the other side panel. The pivot bar is attached to the side panels by suitable means. For example, the pivot bar can be welded to each side panel or the pivot bar can extend through holes 22 in the side panels dimensioned so as to form a tight securing fit with the pivot bar 21. A clamp 23 is optionally positioned on the bottom panel to provide stability for the pivot bar. This is especially desired for those target devices which are designed to hold a large number of targets and thus have a wide open front face and accompanying long pivot bar 21. The clamp 23 is secured to the bottom panel in a conventional fashion. The clamp 23, itself, is bored to permit passage of the pivot bar 21 therethrough.

A plurality of targets 13 are positioned on the pivot bar 21 at spaced intervals. The targets comprise a target face 24, a pivot bar attachment means 25 and a connecting bar 26. The target face, when in a normally upright position, presents a substantially flat face to the gun enthusiast to hit. The attachment means 25 fits over the pivot bar 20 so as to allow the target to revolve freely when hit by a projectile. A hollow cylindrical shaped piece dimensioned to allow the pivot bar to pass therethrough is preferred. This attachment means can be allowed to slide laterally on the pivot bar or spacer means on the pivot bar can be used to restrict its lateral movement. The connecting bar 26 connects the target face 24 with the pivot bar attachment means 25. It is dimensioned to hold the target face up off the bottom panel and present the face as a flat target, essentially perpendicular to the bottom panel. Preferably, wedge shaped means 27 are attached to the connecting bar 26 to keep the target face in the desired upright position. Alternatively, a second bar could extend parallel to the pivot bar across the housing and be positioned such that the connecting bar 26 rests thereon when the targets are in an upright position. Most importantly, the connecting bar 26 is not allowed to rest on the bottom panel; the connecting bar must be held off the bottom panel so as to permit better revolvement about the pivot bar and less chance for ricochet and vibrations. Preferably, the angle formed by the connecting bar and the cover section ranges from about 30° to about 50°.

The return bar 28 is used for resetting the knocked-down targets 13 to an upright position. The return bar is positioned in the housing directly behind the pivot bar. At least one end of the return bar passes through a side panel 18. The return bar is configured such that as it revolves about its axis a portion of it comes in contact with the knocked-down targets and lifts them to an upright position. Thus, the return bar is bent at approximately right angles near each end so that an intermediate portion 29 of the return bar is parallel to, but sufficiently offset from, the end portions which pass through the side panels. One end 30 of the return bar, after passing through the side panel is bent at an approximate 35° to 90° angle to extend backwardly along the side panel. The extremity 31 of the return bar at this bent portion 30 is attached to spring 32. The spring 32 at its other end is secured to the housing 11 by securing means 33. The position of the securing means 33 is such as to allow the spring 32 to remain in its zero tension or relaxed position when the return bar 28 is in its rest position. Extending from extremity 31 is the cord 14. The cord passes through a guide means 34 positioned on the side panel so as to not interfere with the return bar mechanism. The cord then extends to a remote location. The length of the cord 14 is not important, though typically it ranges from about 25 feet to about 75 feet.

When the cord 14 is pulled, the bent portion 30 of the return bar 28 is caused to move which in turn causes the return bar 28 to revolve about its axis. The configured off-set portion 29 of the return bar is then forced to move which results in the knocked-down targets 13 to be lifted and returned to their upright position. When the cord 14 is released, the tension from the spring 32 forces the return bar to revolve back to its rest position as the spring retracts to its relaxed state.

Figure 5:
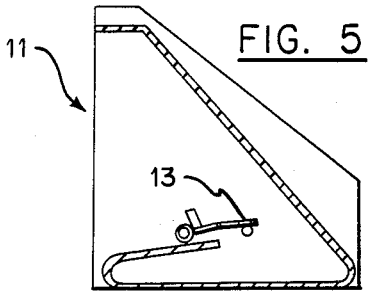
FIG. 5 is a cross-sectional view taken along line 5—5 of FIG. 4.
Figure 4:
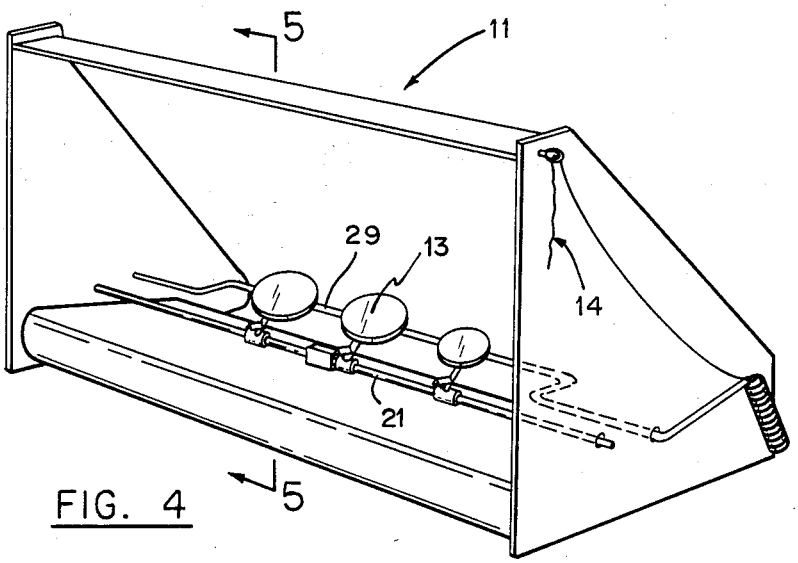
FIG. 4 is a perspective view of the target device after the targets have been knocked down.

FIGS. 4 and 5 show the targets 13 of the target device 11 in a knock-down position. The targets 13 when hit by a projectile revolve about the pivot bar 21 and come to a rest when contact is made with the intermediate portion 29 of the return bar. They remain there until cord 14 is pulled for the purpose of resetting the targets to their upright position.

Figure 6:
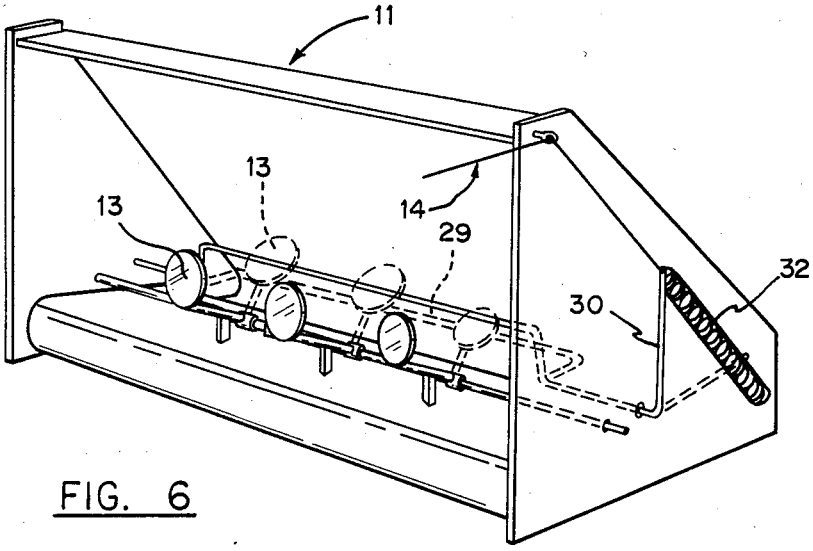
FIG. 6 is a perspective view of the target device showing the operation of the return bar in moving knocked-down targets to an upright position.

FIG. 6 shows the target device in an operational mode wherein the knocked-down targets 13 depicted by dotted lines are moved to an upright position wherein the targets are depicted with solid lines. The return bar 28 when caused to revolve by movement of the cord 14 and bent extremity 30 forces the intermediate portion 29 of the return bar to lift the targets to their normal upright position. As shown in the figure, the wedge 27 holds the target off the bottom panel and thus presents the flat side of the target face to the gun enthusiast.

Figure 7:
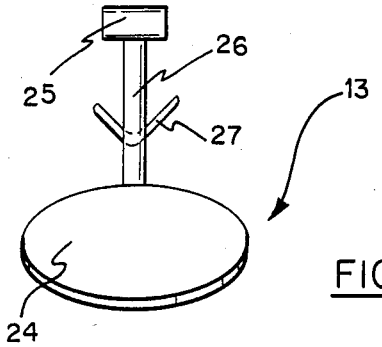
FIGS. 7, 8 and 9 are top, front and side views, respectively, of a target used in the target device.
Figure 8:
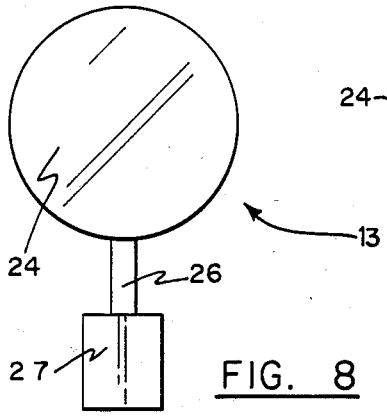
Figure 9:
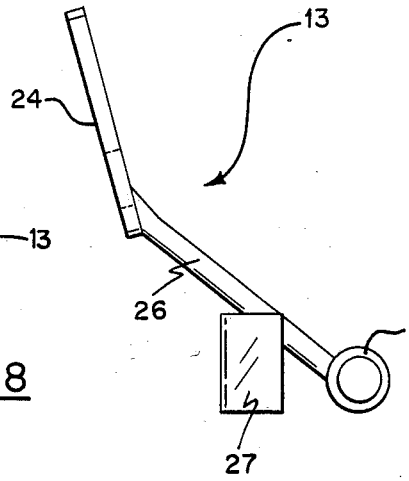

FIGS. 7, 8 and 9 show isolated views of the targets 13. FIG. 7 represents a top view, FIG. 8 a front view and FIG. 9 a side view of the targets. The target face 24 and attachment means 25 is attached to the connecting bar 26 by any suitable means, e.g., welds 35. The angle at which the target face is attached to the connecting bar is such as to ensure the target face will present a substantially flat face to the gun enthusiast when in the upright position. The wedge 27 aids in holding the targets 13 in the proper position.

Figure 10:
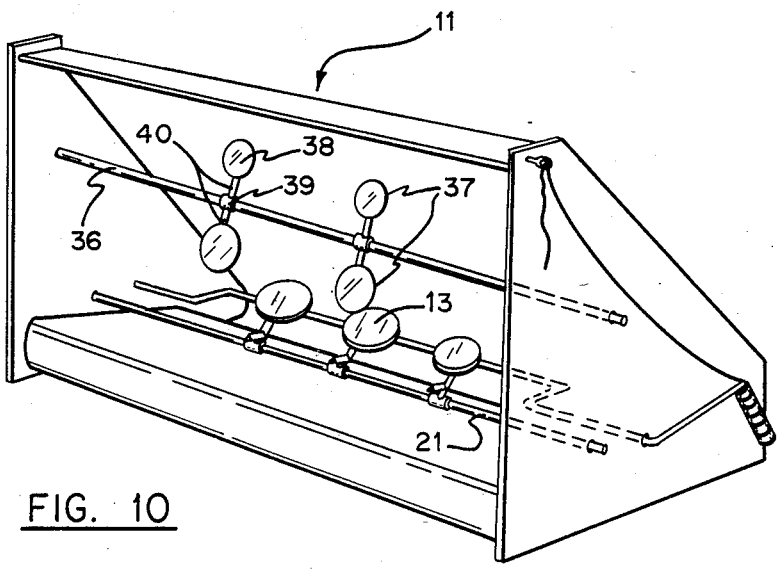
FIG. 10 is a perspective view of a preferred target device having a set of targets which are reset from a remote location and having a set of targets which revolve about their axis when hit by a projectile until the momentum provided by the projectile is expended.

In a preferred embodiment shown in FIG. 10, a second pivot bar 36 is positioned within the housing. The second pivot bar 36 is secured to the side panels 18 in a manner similar to pivot bar 21. The targets 37 mounted on the second pivot bar are attached by attachment means 39. Attachment means 39 are cylindrical in shape and are hollow so as to allow the pivot bar 36 to pass therethrough. In operation, when a projectile hits target face 38, the targets will revolve until friction causes them to eventually stop. Preferably, the target faces 38 have different weights so as to cause the heavier target to always come to a rest at the bottom-most portion of the circle formed by the revolving target. This, in effect, ensures that the flat sides of the targets are always presented to the gun enthusiast. These targets provide a measure of interest in addition to that provided by targets 13.

In operation, the cord is pulled to cause the return bar to revolve and lift the targets to an upright position. The tension in the spring will force the return bar to return to its normal position once tension on the cord is relaxed. When the target face 24 is hit by a projectile, the impact will cause the target to revolve backwards about the pivot bar. Any projectiles which miss the targets will be deflected back into the housing. When one or all the targets are knocked-down, the gun enthusiast again pulls the cord to return the targets to their normal upright position. The cord is long enough that the gun enthusiast can remain in his shooting position to reset the targets and continue with his target paractice.

While certain specific embodiments have been shown, it should be realized other variations of the invention are readily apparent. For instance, the target faces can have any shape. They can have any geometrical shape as well as be shaped to form an animal's silhouette. Additionally, any number of targets can be positioned on the pivot bars 21 and 36. Preferably, the housing is made of a heavy gauge metal capable of withstanding the force of a projectile. Other suitably resistant materials could instead be used in the housing's construction, e.g., plastic.

What is claimed is:

1. A target device comprising a plurality of spaced individual targets mounted on a pivot bar, said targets being mounted so as to move from a normal upright position to a knock-down position upon impact with a projectile, said device comprising:

(a) A housing with an open front face, a back panel capable of withstanding the impact of a projectile and acting as a back-stop, a bottom panel and two side panels;

(b) a horizontal target pivot bar extending to each of the side panels of the housing;

(c) a plurality of targets positioned on the target pivot bar at spaced intervals, said targets comprised of (1) a target face, (2) an attachment means for permanent mounting on the target pivot bar and which allows the target to pivot thereon and (3) a connecting bar between the target face and attachment means, said connecting bar angled such that when the target is in a normally upright position, the target face is held off the bottom panel; and (d) a return means for resetting the targets from a knock-down position to a normally upright position from a remote location, said return means comprising (1) a return bar positioned behind the target pivot bar wherein at least one end of the return bar passes through a side panel, said return bar being configured such that as it revolves about its axis a portion of it comes in contact with the targets and moves them from a knock-down position to an upright position and wherein the one end, after passing through the side panel, is bent at an angle such that it extends back from the open face of the housing (2) a spring attached at its first end to the extremity of the return bar which is bent and attached at its second end to the side panel and (3) a cord extending from the extremity of the return bar through a guide means attached to the side panel and then to a remote location wherein a pull on the cord will cause the return bar to revolve about its axis thereby causing the targets to move from a knock-down position to a stable upright position and release of the cord will release tension on the spring means which in turn will allow the return bar to return to its rest position.

2. The target device of claim 1 wherein the return bar is configured so as to form an intermediate portion which is parallel to its end portions, but sufficiently off-set therefrom to provide lift means for the targets.

3. The target device of claim 2 wherein the return bar is bent at two approximate right angles near each end so as to form the intermediate portion.

4. The target device of claim 3 wherein the end of the return bar after passing through the side panel is bent at an about 35° to about 90° angle so as to extend back from the open front face.

5. The target device of claim 1 having a clamp means for providing stability to the pivot bar.

6. The target device of claim 1 wherein the back panel slopes from a point near the top of the open front face downwardly to the back of the bottom panel so that missed projectiles will be directed into the back of the housing.

7. The target device of claim 1 wherein the back panel comprises a top portion substantially horizontal to the bottom panel and a lower portion sloping from the back of the top portion to the back of the bottom panel.

8. The target device of claim 7 wherein the bottom panel has a bottom support section, a rounded return section and a cover section which extends back over the bottom support section and the pivot bar is mounted over the cover section.

9. The target device of claim 8 wherein the cover section extends about midway back over the bottom support section so as to form a trap for missed projectiles.

10. The target device of claim 9 wherein the cover section is sloped in an upward fashion to direct missed projectiles into the back of the housing.

11. The target device of claim 1 wherein the attachment means for the targets are hollow cylindrical shaped pieces which permit the pivot bar to pass therethrough and allow the targets to pivot about the pivot bar.

12. The target device of claim 11 wherein a wedge shaped means is positioned on the connecting bar of the individual targets to hold the individual targets in an upright position to present a substantially flat target face.

13. The target device of claim 1 additionally comprising a second pivot bar extending across the open front face and within the housing, said second pivot bar having mounted thereon a plurality of targets capable of revolving about the second pivot bar when hit by a projectile.

14. The target device of claim 13 wherein each target on the second pivot bar is comprised of two target faces, attachment means for permanent mounting on the pivot bar which allows the targets faces to revolve therearound and connecting bars leading from each target face to the attachment means.

15. The target device of claim 14 wherein one target face is heavier than the second target face so as to cause the heavier target face to settle at the bottom of a circle formed by the revolving targets and thus present the target faces to projectiles entering the housing through the open front face.

* * * * *